US006453134B1

(12) United States Patent
Ziegelmuller et al.

(10) Patent No.: US 6,453,134 B1
(45) Date of Patent: Sep. 17, 2002

(54) WEB-CLEANING APPARATUS FOR ELECTROSTATIC PRINTER/COPIER

(75) Inventors: Francisco L. Ziegelmuller, Penfield; Carol K. Dunn, Rochester; Maria B. Carrone, Scottsville; George D. Gross, Rochester, all of NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 09/738,753

(22) Filed: Dec. 15, 2000

(51) Int. Cl.[7] ..... D03G 21/00

(52) U.S. Cl. ..... 399/101; 399/123; 399/297; 399/350

(58) Field of Search ..... 399/98, 99, 101, 399/123, 297, 303, 350

(56) References Cited

U.S. PATENT DOCUMENTS 4,866,483 A 9/1989 Davis et al.
5,426,485 A 6/1995 Fujita et al.
5,500,723 A * 3/1996 Godlove ..... 399/350 X
5,873,016 A * 2/1999 Kurokawa et al. ..... 399/297
6,075,965 A 6/2000 Tombs ..... 399/308

* cited by examiner

*Primary Examiner*—William J. Royer
(74) *Attorney, Agent, or Firm*—James D. Leimbach

(57) ABSTRACT

Apparatus for cleaning particulate material from the surface of a moving web comprises: (i) a customer-replaceable cleaning cartridge including a pair of spaced, parallel cleaning blades supported by a sump housing having a removable lid assembly with a narrow opening through which the blades project at an angle; (ii) a backup shoe assembly positioned to contact the web surface opposite the cleaning blades and provide resistance to the cleaning blades; and (iii) a bracket assembly for releasably supporting the cleaning cartridge in an operative position in which the cleaning blades contact the web surface to be cleaned and cooperate with the shoe assembly to wipe particulate material from the web. Preferably, the lid assembly comprises a lid member that supports a flexible seal blade that contacts the web surface upstream of the cleaning blades and deflects particulate material wiped from the web by the cleaning blades into the sump housing. Preferably, the lid member defines an external cavity that serves as a reservoir for receiving particles inadvertently wiped from the web by the seal blade.

13 Claims, 7 Drawing Sheets

WEB-CLEANING APPARATUS FOR ELECTROSTATIC PRINTER/COPIER

CROSS REFERENCE TO RELATED PATENT APPLICATIONS

Reference is made to the commonly assigned U.S. patent application Ser. No. 09/738,751, filed concurrently herewith and entitled "SUPPORT BRACKET/BACKUP SHOE ASSEMBLY FOR WEB-CLEANING CARTRIDGE."

BACKGROUND OF THE INVENTION

1. Field of the Invention

This invention relates generally to improvements in cleaning apparatus of the type used, for example, in electrostatic document printers or copiers to remove residual toner, carrier, dust, lint, paper fibers and the like from a moving surface, typically in the form of an endless web or drum.

2. Discussion of the Prior Art

Heretofore, blade cleaners have been used in electrophotographic copiers and printers to remove particulate material, e.g., toner, carrier, dust, lint, paper fibers, and the like, from various moving surfaces within the instrument. Such surfaces typically include the relatively delicate outer surfaces of image-recording and image-transfer elements, as well as the somewhat less delicate surfaces of endless webs used to transport a sheet material from one image processing station to another.

Blade cleaners are often classified by the way they operate to clean the moving surface they contact. Some operate in a "scraping" mode; others operate in a "wiping" mode. When operating in a scraping mode, the blade element is set at an obtuse angle (typically between 100 and 120 degrees) relative to the oncoming surface it is intended to clean. Thus, the blade edge opposes the movement of the surface and deflects particulate material from the surface as it initially engages the blade edge. When operating in a wiping mode, the blade element is set at an acute angle (typically between 60 and 85 degrees) relative to the oncoming surface it is to clean. Thus, the blade edge extends slightly in the direction of travel of the moving surface, and particles are wiped from the surface as the surface moves away from the blade edge. Obviously, the scraping mode is harsher on the moving surface and usually requires a lubricant to prevent the blade from becoming unstable and tucking under. In applications where considerable amounts of toner (which serves as a blade lubricant) remain on a surface for cleaning, scraping blades are often preferred, since they are more flexible to machine configuration. In applications that require long runs without toner or any other self-lubricating material, wiper blades are preferred due to their inherent stability. Both types of blade cleaners (i.e., scrapers and wipers) are disclosed in U.S. Pat. No. 5,426,485 in which cleaning blades serve to remove particulate material from an endless elastic belt used to convey copy sheets in an electrostatic copier. In this patent the pressure applied by the blade is adjustable as a function of belt temperature.

U.S. Pat. No. 4,866,483 discloses a blade-type cleaning station for a table-top electrostatic printer. A pair of spaced, parallel cleaning blades, set to operate in a wiping mode, serve to remove residual toner from an endless photoconductive image-recording belt following transfer of a toner image to a copy sheet. The cleaning station further includes a rotatably driven auger for transporting most of the scavenged residual toner collected in a sump to a remote receptacle for removal. The cleaning station is stationary within a printer's base frame, and the entire print engine, including the image-recording belt, is mounted on a pivoting frame for movement between closed and open positions, toward and away from the cleaning station. In its closed position, the print engine's image-recording belt pressingly engages the respective edges of the cleaning blades and is thereby positioned to be cleaned by the blades as the belt advances along its endless path. In its open position, the belt is sufficiently spaced from the blades so that the cleaning station may be readily serviced, e.g., to vacuum scavenged toner from that portion of the sump directly beneath the cleaning blades, or to replace the cleaning blades themselves. Here, the blades are loosely supported at opposite ends in a pair of guide channels formed in the end walls of the sump housing. Each blade has a pair of downwardly depending pegs at opposite ends. These pegs fit into the central portion of a coil spring located in each guide channel, such coil springs acting to urge the blades into contact with the moving belt when the print engine frame has been returned to its closed position. In use, the cleaning blades operate on an unsupported region of the image-recording belt.

While the cleaning station disclosed in the above-noted patent affords certain advantages not found in prior devices, it may still be viewed as problematic in certain respects. For example, the sump housing that receives toner wiped from the belt surface by the blade cleaners is relatively small, thereby requiring the relatively costly auger system to continuously transport particles to a remote location for storage prior to removal. Further, while ready access may be gained to the cleaning station by simply pivoting the print engine frame to its open position, there is no fool-proof way of removing the scavenged particulate material from the blade housing (sump) without some potential for blowing the particles throughout the machine frame. Once the print engine has been pivoted to its open position to gain access to the scavenged particle sump for vacuuming, the entire sump is exposed to ambient air, and any air currents in the vicinity of the open sump can have the effect of blowing toner, throughout the instrument. Ideally, the scavenged particle sump should be easily removed from the vicinity of the machine frame while scavenged particles are confined therein. Once removed, the sump may be discarded and replaced with a new sump, or it may be cleaned at a location safely spaced from the machine and then replaced. Also, since there is no lid or cover on the top of the sump, scavenged particles can escape the sump and contaminate the machine elements while the machine is in operation. Further, since there is no hard back-up for the web to resist the pressure applied on the web by the cleaning blades, the web is likely to stretch over time, thereby changing the dynamics at the blade edge/web interface.

SUMMARY OF THE INVENTION

In view of the foregoing, an object of this invention is to provide a blade-type cleaning apparatus of the above type that overcomes the noted disadvantages of the prior art devices.

Another object of this invention is to provide a relatively low-cost, operator-replaceable cartridge comprising one or more wiper blades supported by an enclosed particle sump that is easily removed from a printer/copier so that the cartridge may be serviced away from the machine or, alternatively, discarded and replaced with a new cartridge.

A further object of this invention is to provide an improved method for cleaning particulate material from a moving surface.

As will become more apparent from the ensuing detailed description of preferred embodiments, these and other objects of the invention are realized, in accordance with a first aspect of the invention, by the provision of a web-cleaning apparatus comprising an operator-replaceable cleaning cartridge adapted to be releasably supported by a bracket in a position to engage a moving surface of a web to be cleaned. Such cleaning cartridge comprises (a) a pair of cleaning blades each comprising an elongated rigid member with a flexible blade member; (b) a sump housing for releasably supporting the blades in a spaced parallel relationship and for receiving and storing particulate material removed from the moving surface by the blades; and (c) a lid assembly, operatively connected to said sump housing to form a substantially enclosed chamber therewith. The sump housing has a pair of opposing end walls, each defining a pair of spaced notches for receiving and supporting an end of one of the blades. The notches are positioned to locate the respective edges of the blades in a spaced, parallel relationship, with each of the flexible blade members extending at a predetermined acute angle relative to a planar upper surface of the lid assembly. The lid assembly comprises a lid member defining an elongated opening through which the flexible blade members of the wiper blades project when the wiper blades are supported in the notches of the sump housing. The opening in the lid has a rectilinear lip supporting a flexible seal blade having a rectilinear edge spaced from said wiper blades and extending parallel thereto. The seal blade is substantially more flexible than the flexible blades of the wiper blades and, in addition to sealing the upstream end of the sump housing to prevent the escape of scavenged particles, also operates to deflect into said enclosed chamber particulate material wiped from a moving surface by at least one of the wiper blades. Preferably, the lid member defines an open auxiliary reservoir for receiving any particulate material wiped from the moving surface by the seal blade. Also preferred is that the upper surface of the lid member supports at spaced, parallel locations, two strips of a compressible material which cooperate with the moving surface to prevent particulate material in said sump from escaping from the sides of the sump housing. The cartridge is easily accessible to the operator by means of a bracket, described in the above-referenced U.S. patent application, filed concurrently herewith, that is releasably latched to a hard backup assembly and can be quickly unlatched and dropped for easy installation, service and removal of the cleaning cartridge. The cartridge-supporting bracket can also be quickly removed from the backup assembly for installation or removal of a transport or transfer web.

In accordance with another aspect of the invention, the web-cleaning apparatus of the invention comprises, in addition to the above-noted cleaning cartridge, a hard back-up member or "shoe" that is positioned on the opposite side of the moving web from the wiper blades of the cleaning cartridge. Preferably, the back-up member is part of a two-piece bracket assembly used to releasably support and position the cleaning cartridge relative to the web surface and a backup shoe or pressure plate in order to achieve a uniform pressure across the web.

Due to the construction of the operator-replaceable cleaning cartridge, a machine operator can perform periodic maintenance on the cleaning station with minimum downtime. Moreover, the application of the cleaning blades against a stationary hard backup minimizes any adverse effect the blades might have on the web-tracking system and on color registration (e.g., in a full color document printer) since the stationary backup does not steer the web, and the blades are designed with enough compliance to reduce load variations due to differential in engagement between front and rear of the cleaner, as may be found in other applications where the blades abut against a roller, and the blades are considerably stiffer. Also advantageous is that an auxiliary waste reservoir in the lid assembly serves to contain any particles that may get deflected in a direction upstream of the cleaning blades. While the first blade that contacts the web does the bulk of the cleaning work including the function of trapping paper dust, fibers, lint and oil from the transport web, the second blade then continues the cleaning process, thereby extending the cleaning function of the cleaning station over longer periods of time. The dual wiper blades ensure consistency and extended life cleaning performance while avoiding the problems of instability or tuck-under encountered with scraper blades. The efficiency of the first blade in trapping fibers, lint and other debris eliminates the need for a fur brush.

The invention and its various advantages will be better understood from the ensuing detailed description of preferred embodiments, reference being made to the accompanying drawings in which like reference characters denote like parts.

BRIEF DESCRIPTION OF THE DRAWINGS

The invention and its objects and advantages will become apparent upon reading the following detailed description and upon reference to the drawings, in which.

DETAILED DESCRIPTION OF THE PREFERRED EMBODIMENTS

While the present invention will be hereinafter described in connection with a preferred embodiment thereof, it will be understood that it is not intended to limit the invention to that embodiment. On the contrary, it is intended to cover all alternatives, modifications and equivalents as may be included within the spirit and scope of the invention, as defined by the appended claims. Further, although the cleaning apparatus of the invention is particularly well adapted for use in an electrostatic printing machine to clean marking particles (toner) and other particulate material from an endless web used to transport image-receiver sheets, it will be evident from the ensuing description that it is equally well suited for use in a wide variety of devices to clean particulate material from different types of moving surfaces.

Figure 1:
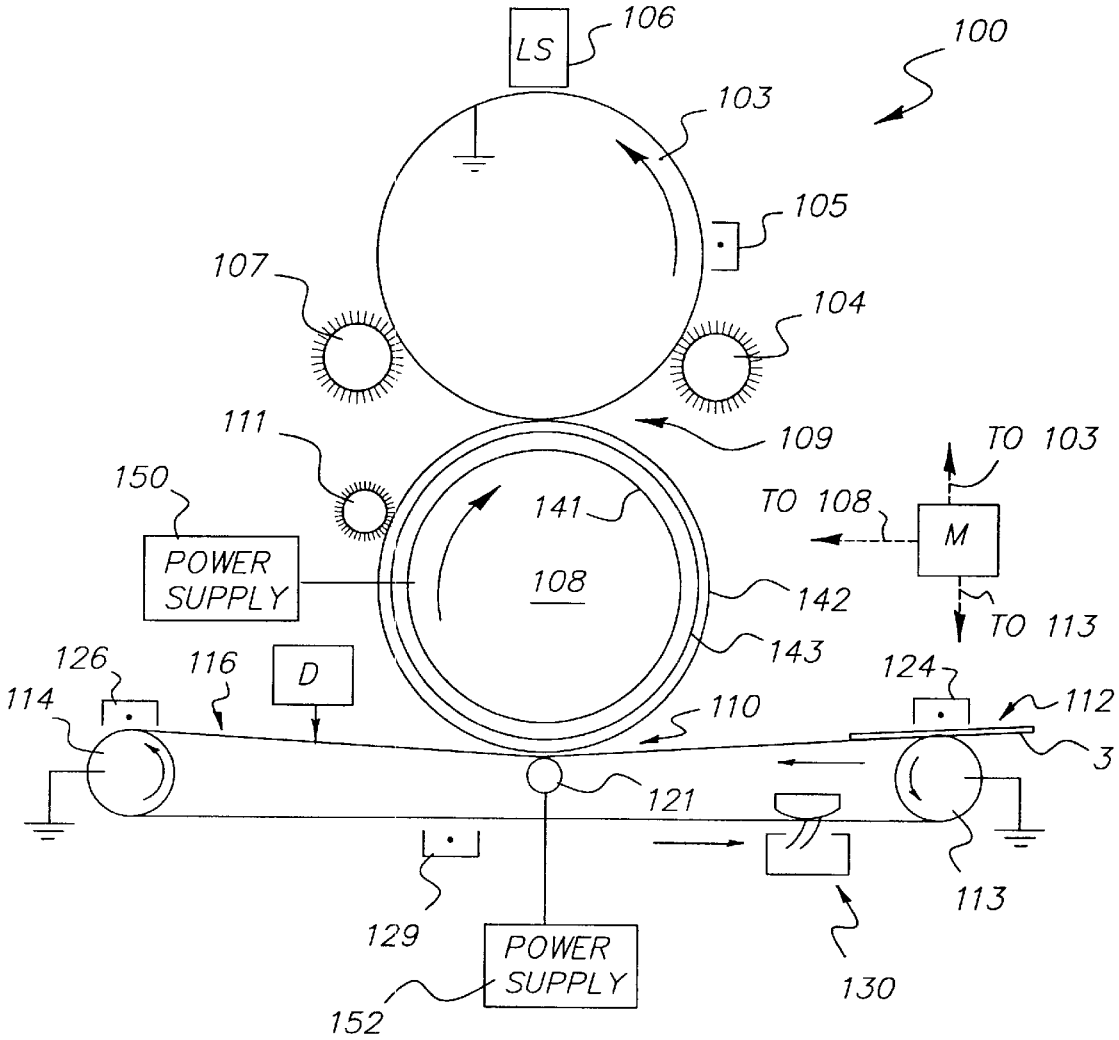
FIG. 1 is a schematic illustration of an electrostatic document printer in which the invention is useful and is shown as being embodied.

Referring now to FIG. 1, a conventional electrophotographic document printer 100 is shown to comprise a primary image-forming member 103, for example, a rotatably driven conductive drum having an outer surface of a photoconductive material. One or more transferable toner images are formed on the photoconductive surface of drum 103 by first uniformly charging the surface with electrostatic charge provided by a corona charger 105 or the like. The uniformly charged surface is then imagewise exposed to actinic radiation provided, for example, by a laser scanner 106, thereby selectively discharging the charged surface and leaving behind a latent charge image. Finally, the latent charge image is rendered visible (developed) by applying electroscopic toner particles using a magnetic brush applicator 107, or the like. In some printers of this type, a series of toned process control patches (images) are also formed on the surface of the image-recording element, such patches being located in the interframe region between successive image frames.

The above-noted toner images and toned process control patches are then transferred to an intermediate image-transfer member 108 at a transfer nip 109. Any residual toner on the image-forming member 103 is removed by a cleaning brush 104 prior to recycling the image-recording member through the image-forming process. The image-transfer member may comprise, for example, an electrically-conductive drum 141 having a compliant blanket 143 with a relatively hard overcoat 142. The conductive drum 141 is electrically biased by a power supply 150. The toner images transferred onto intermediate image-transfer member 108 are then re-transferred to an image-receiver sheet S at a second image-transfer nip 110 formed by a relatively small transfer roller 121 and an endless sheet-transport web 116 made of a dielectric material such as a polymer compound. The toner images are electrostatically attracted to the image-receiver sheets by a suitable electrical bias applied to transfer roller 121 by a power supply 152. Residual toner on member 108 is removed by a cleaning brush 111.

The image-receiver sheets are presented to the endless sheet transport web 116 at a sheet-feed station 112. Web 116 is trained around a pair of rollers 113 and 114, and a motor M serves to drive roller 113 in the direction indicated by the arrow. Motor M also serves to rotatably drive the image-forming and image-transfer drums. The image-receiver sheets (e.g., paper or plastic) attach to web 116 at a corona charging station 124 which operates to charge the top surface of the sheet so that it becomes electrostatically attracted to the web. The rollers 113 and 114, which are grounded, serve to charge to the backside of the web. A corona charger 126 serves to detack the image-receiver sheets as they wrap around transport roller 114, thereby freeing the sheets for further transport to a toner fusing station, not shown. Note, being outside the image frame areas on the image-forming drum, any toned process-control patches transferred to the image-transfer member 108 will re-transfer directly to the transport web in the region between successive image-receiver sheets. These toned patches must be removed from the web before receiving a new image-receiver sheet. Otherwise, the toner from these patches will transfer to the rearside of the image-receiver sheets. An electrophotographic document of the type shown in FIG. 1 is more thoroughly described in U.S. Pat. No. 6,075,965, issued on Jun. 13, 2000 in the names of Tomb et al., the contents of which are incorporated herein by reference.

Now, in accordance with the present invention, a new and improved web-cleaning apparatus 130 is provided for removing not only the random toner particles, dust, paper debris, and the like that may accumulate on the outer surface of the transport web 116 during repeated use of the printer described above, but also any relatively heavy deposits of toner that may be transferred to the web, for example, as the result of forming the aforementioned process-control patches on the image-forming drum, paper jams, misregistration of a toner image to the image-receiver sheet, and the like. As indicated above, such toned patches (designated as TP in FIG. 3) are formed at predetermined locations on the image forming members in the interframe areas and are used, for example, to control registration of multiple color-separated images on the surface of a single image-receiver sheet and/or to monitor the effectiveness of the image-forming process across the width of the image forming member. These patches get transferred to the web in the spaces between successive image-receiver sheets and are "read" on the web by a densitometer D located downstream of the second image-transfer nip 110. As will be appreciated, all particles on the sheet-bearing surface of web 116 should be removed or cleaned from the web before the web receives a new image-receiver sheet. The web-cleaning apparatus of the invention, generally designated as "130" is particularly well adapted to perform this duty and, as shown, is positioned downstream of a transport web conditioning charger 129 that acts to discharge the web surface to facilitate the cleaning function.

Figure 2:
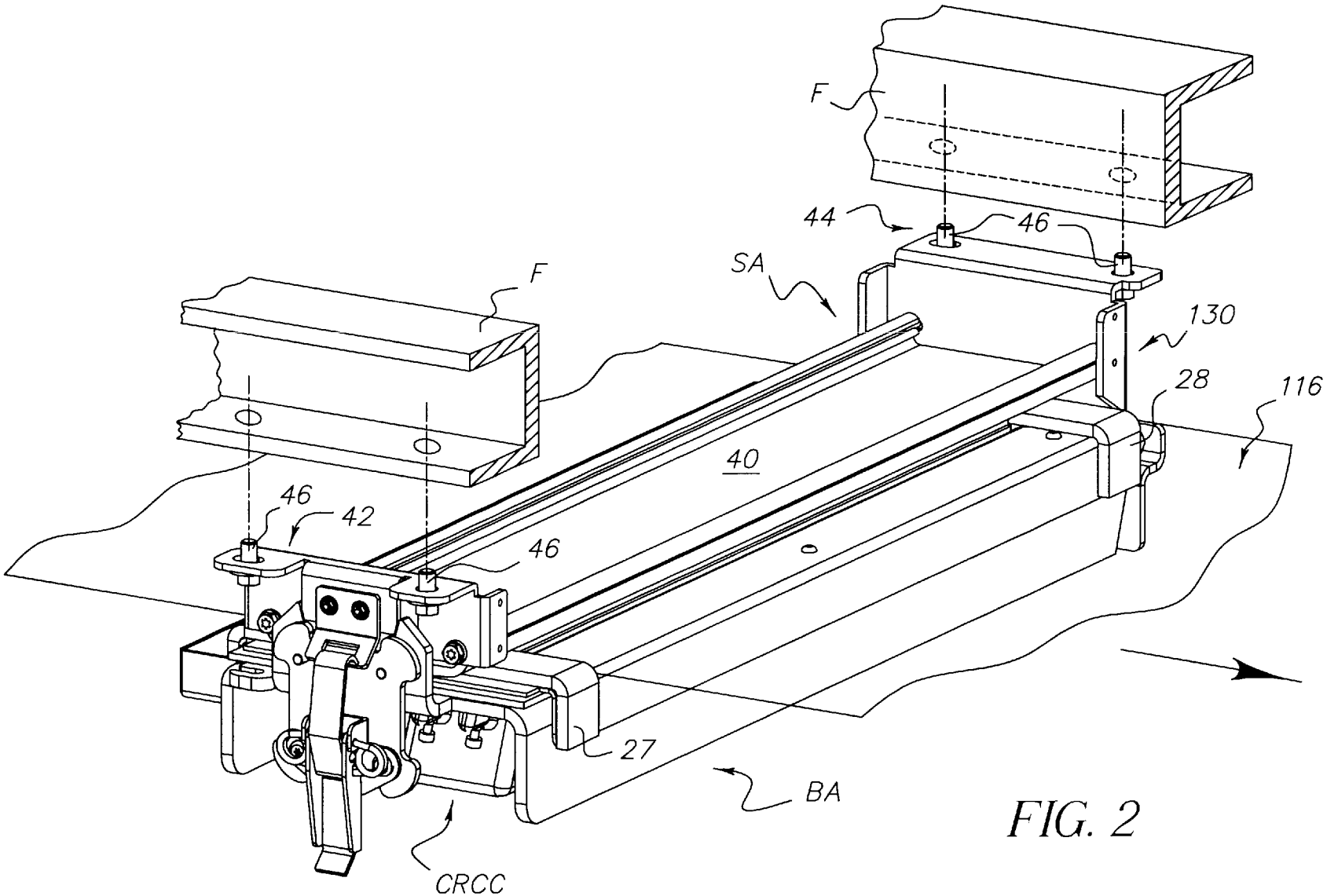
FIG. 2 is a perspective view of a preferred embodiment of the web-cleaning apparatus of the invention, such apparatus shown to be operating on the surface of a sheet-transport web comprising the FIG. 1 printer.
Figure 3:
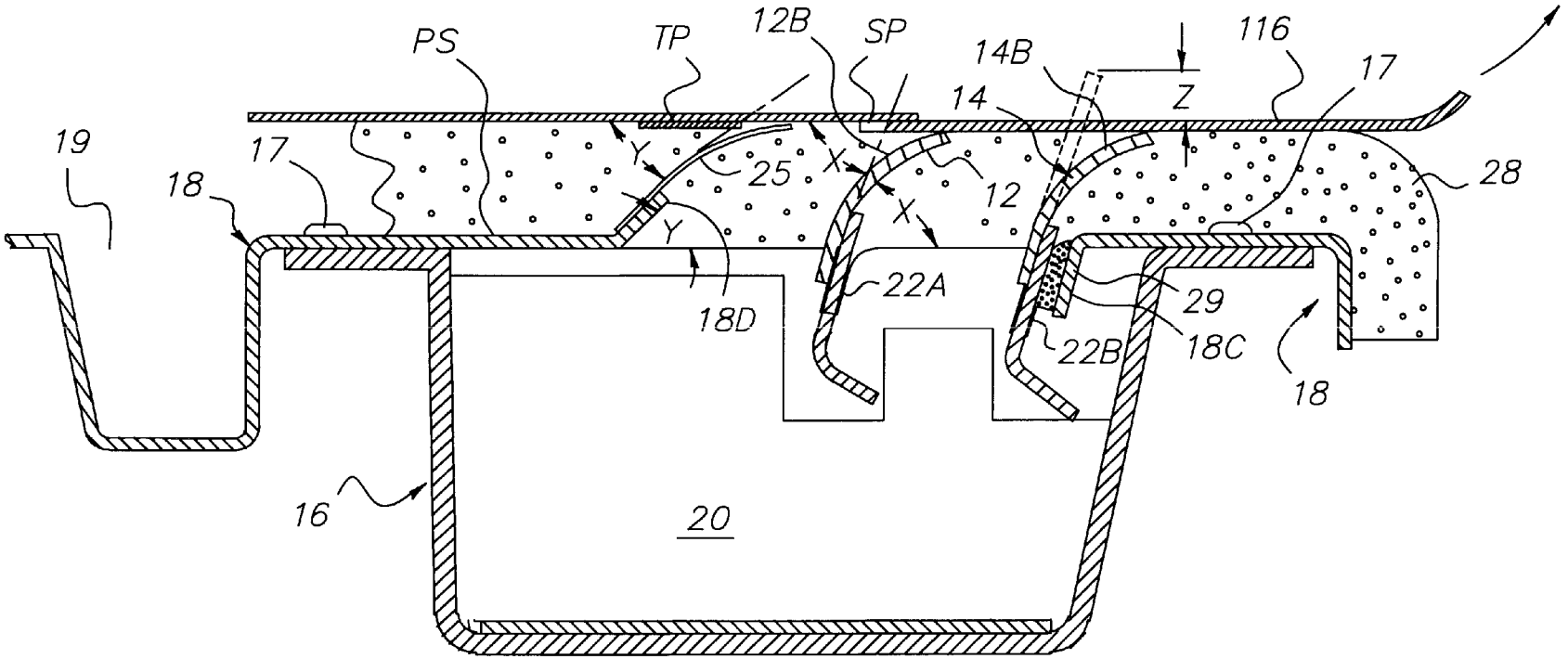
FIG. 3 is a cross-sectional illustration of the FIG. 2 apparatus.
Figure 4:
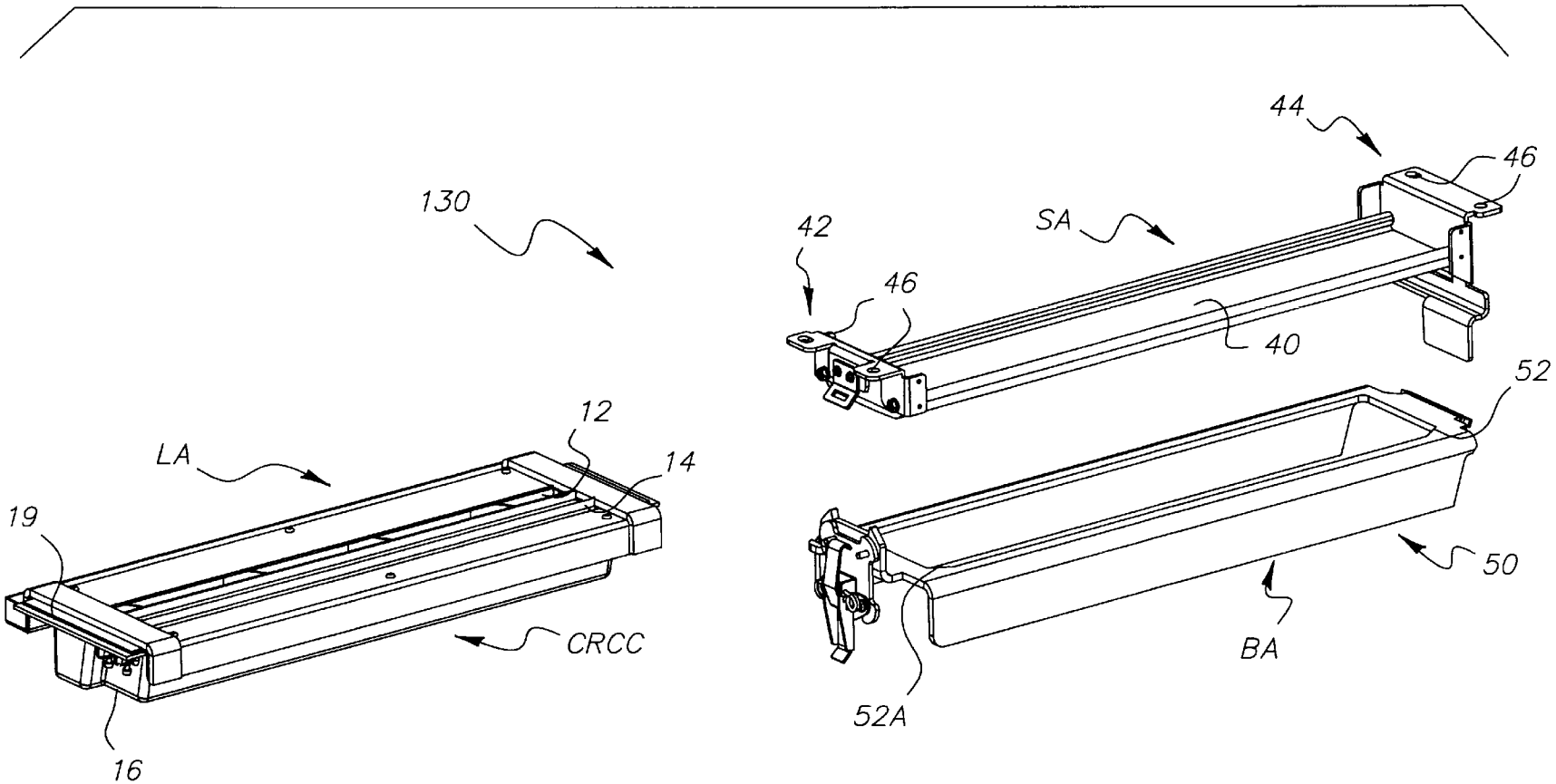
FIG. 4 is a perspective view of three major components of the FIG. 2 apparatus.

Referring to FIGS. 2–6, and particularly to FIG. 4, a preferred web-cleaning apparatus 130 is shown as comprising three major components, namely, a customer-replaceable cleaning cartridge CRCC that provides a web-cleaning function, a support bracket assembly BA for releasably supporting the CRCC in an operative position within the printer adjacent the web surface to be cleaned, and a back-up shoe assembly SA for providing a hard resistance to the pressure applied on the web by the CRCC. As better described in the aforementioned cross-referenced U.S. patent application Ser. No. 09/738,751, filed concurrently herewith, the contents of which being hereby incorporated by reference herein, the shoe assembly further serves to releasably support the bracket assembly for movement between an operative position in which the bracket supports the CRCC in a position engaging web 116, and a service position in which the bracket assembly is supported in a position spaced from the web so that the CRCC can be readily removed from the printer and/or serviced.

Figure 5:
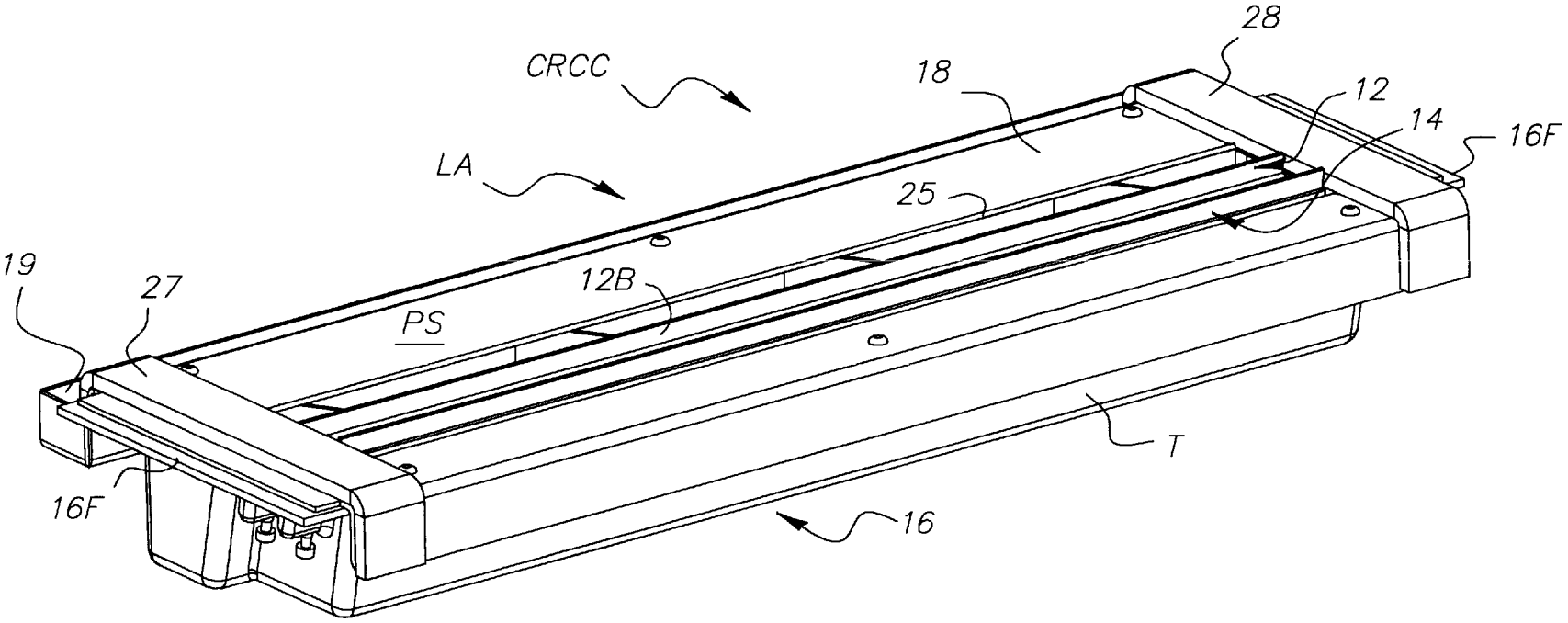
FIG. 5 is a perspective view of the a customer-replaceable cleaning cartridge comprising the FIG. 2 apparatus.
Figure 6:
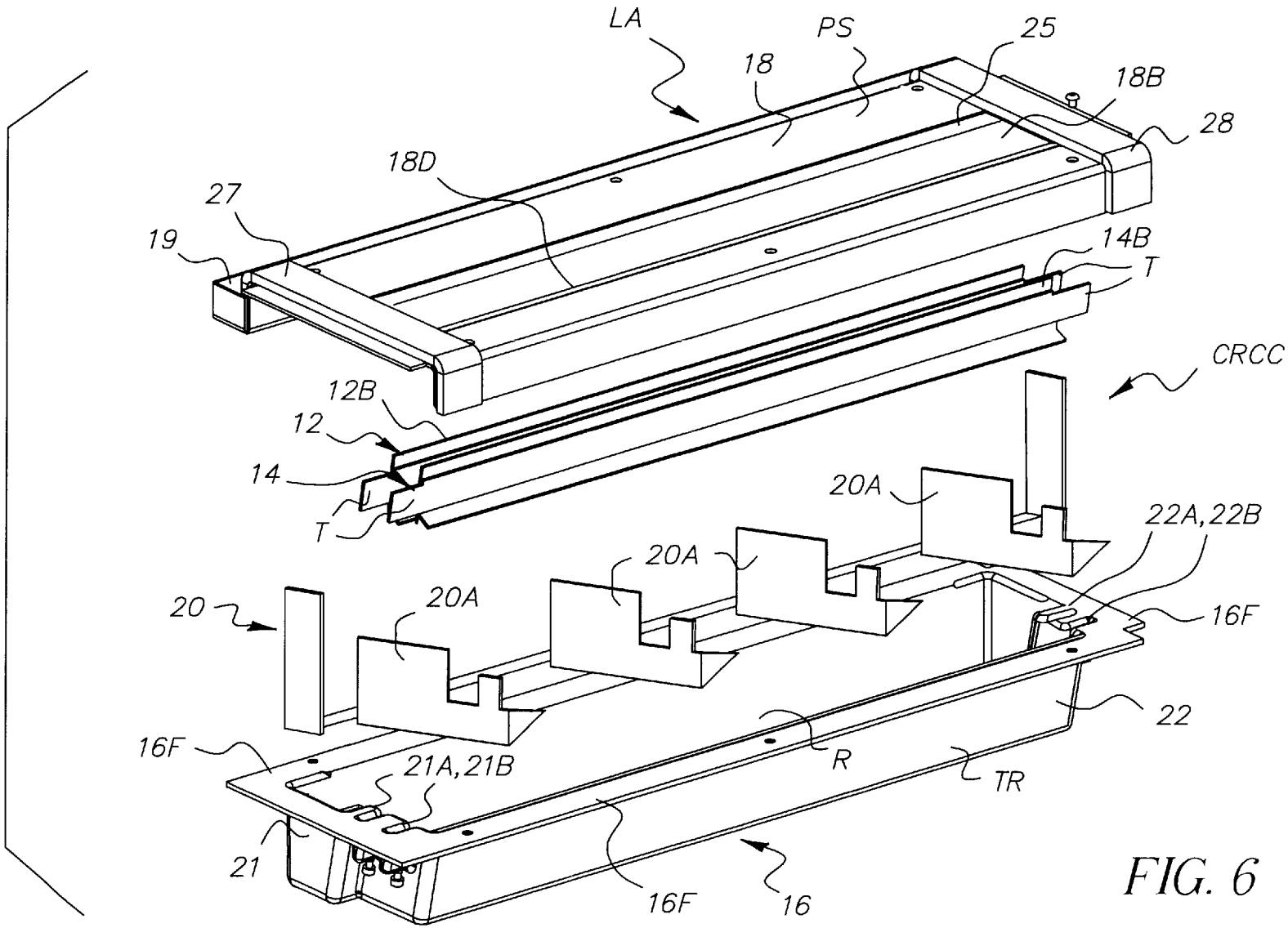
FIG. 6 is an exploded view of the cleaning cartridge shown in FIG. 5.

Referring to FIGS. 3, 5 and 6, the CRCC comprises a pair of cleaning blades 12, 14 adapted to contact the outer surface of web 116 and to wipe particulate material therefrom; a sump housing 16 for releasably supporting the cleaning blades 12, 14 in a spaced parallel relationship and for receiving and storing particulate material removed or scavenged from the outer surface of web 116 by the cleaning blades 12, 14; and a multi-purpose lid assembly LA attached to the top of the sump housing 16 that serves not only to prevent scavenged particles from escaping the edges of the sump housing 16, but also to both clean the edges of the web and collect particles deflected from the web by a seal blade (described below) at a location upstream of the cleaning blades 12, 14. Optionally, the CRCC further comprises an internal baffle 20 (shown in FIG. 6) that is positioned within the sump housing to prevent any sudden displacement and subsequent spillage of scavenged particles as the aforementioned bracket assembly BA is moved to its service position in which the CRCC can be removed from the machine. Preferably, the sump housing 16, and optional baffle are made from an injection-molded plastic having a carbon doping for static dissipative purposes to avoid excessive charge build up. Preferably, the volume resistivity of such plastic material is between $10^8$ to $10^{11}$ ohm-cm.

Figure 7C:
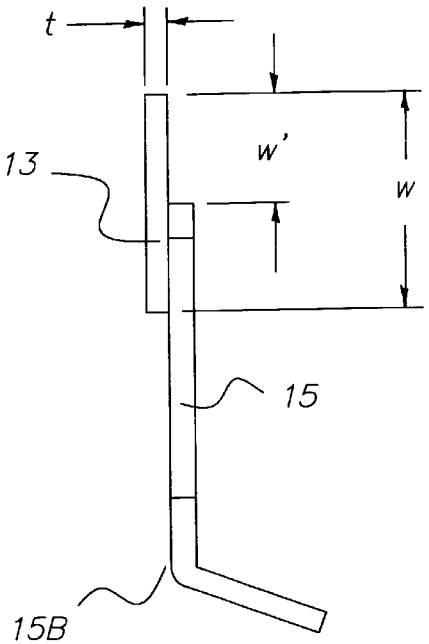
FIGS. 7A, 7B and 7C are perspective, front and side elevations of a preferred cleaning blade.
Figure 7A:
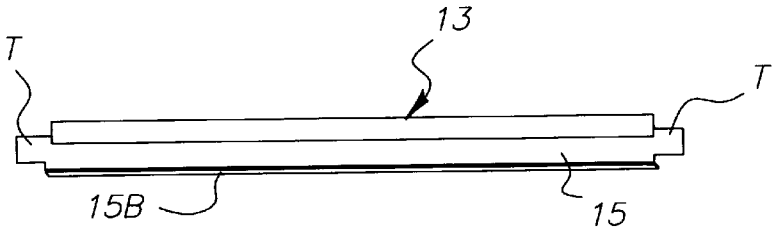
Figure 7B:
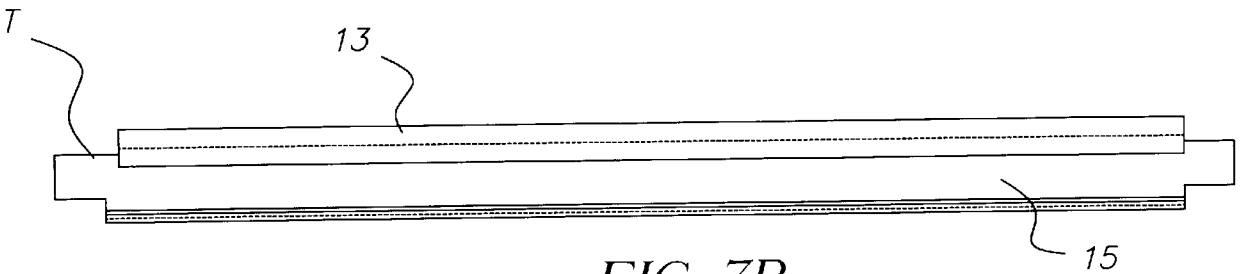

Referring to FIGS. 7A–7C, each of the cleaning blades 12, 14 comprises a flexible blade element 13 and a rigid stiffening plate 15. The flexible blade element 13 preferably comprises a rectangular slab of polyester polyurethane with the following properties: a hardness of between 60 and 85 Shore A, an initial modulus of between 500 and 1500 psi, a Bayshore resiliency above 30%, and a compression set lower than 25%. The polyurethane slab is fabricated with a thickness t of about 0.050" and a width w of 0.500". The length of the flexible blade elements 13 may be equal to the width of web 116. Preferably, the blades extend about 12 mm to about 25 mm beyond each of the edges of the widest image-receiver sheet size but within the belt width. The polyurethane slab is glued to the stiffening plate 15, the latter preferably being made of steel, so as to produce a free extension w' of 0.250" (see FIG. 7C). In general, the ratio of the polyurethane thickness to the free extension should be between 0.125 to 0.250. As shown, the steel stiffener plate 15 is provided with a bend 15B along one edge thereof, thereby giving the plate a somewhat L-shaped cross-section. The purpose of the bend 15B is to reduce any bending tendency of the stiffening plate 15 along its length. The bend angle is preferably between 90 and 150 degrees, and it should be such as not to provide a barrier to particle flow into the sump housing 16. A pair of opposing extension tabs T is provided on each stiffening plate 15 for mounting the blades 12, 14 on the sump housing 16. Tabs T are designed so that they rest on the respective bottom surfaces of a pair of supporting notches formed in the sump housing side walls, as described below. When so seated, the cleaning blades 12, 14 are in a locked position relative to the direction of motion of the web 116. Preferably, prior to use, the flexible blade edges are initially dusted with toner, Teflon®, Kynar, PMMA, zinc stearate, or other suitable dry lubricant to reduce friction with the web 116 at installation.

As best shown in the exploded view of the CRCC shown in FIG. 6, sump housing 16 comprises a generally rectangular tray TR, preferably made of plastic and injection-molded, that defines a reservoir for receiving particulate material removed from the web 116. The tray TR has four mutually perpendicular flanges 16F by which it is supported by the support bracket assembly BA, and a pair of opposing side walls 21, 22. Each side wall 21, 22 defines a pair notches, i.e., notches 21A, 21B in side wall 21, and notches 22A, 22B in side wall 22. As indicated above, these notches are shaped to support the extension tabs T extending axially from the respective ends of the cleaning blades 12 and 14. The notches 21A, 21B, 22A, 22B are so located and oriented in the side walls 21, 22 so as to support the two cleaning blades 12, 14 in a spaced, parallel relationship, with blade elements 12B and 14B being arranged at an acute angle X relative to the upper planar surface PS of a lid member 18 comprising the lid assembly LA. In use, the CRCC is supported (by the bracket assembly BA) in an operative position with respect to the web surface such that the blades 12, 14 are arranged at an acute angle X (shown in FIG. 3) relative to the oncoming web surface (i.e., the upstream portion of the web). Thus, the blade elements 12B, 14B will be supported in a "wiping" mode, as explained above. The CRCC is designed so that no fasteners are needed to mount the cleaning blades on the sump housing 16. The blades 12, 14 are installed by simply dropping the extension tabs T of the blades 12, 14 into the notches 21A, 21B, 22A, 22B of the sump housing 16. Thus, the blades are removed by simply lifting them out of their supporting notches 21A, 21B, 22A 22B. The blade-supporting notches 21A, 21B, 22A, 22B are arranged so as to produce a predetermined and desired wiping angle and interference with the surface to be cleaned. Preferably, the wiping angle is between 60 and 85 degrees and, most preferably, about 80 degrees. The amount of blade interference Z with the web surface (shown in FIG. 3) depends on the stiffness of the blade and the desired load to clean. In general, this interference can be between 0.010" to 0.100" and is, preferably, between 0.010" and 0.060", and a normal load is within the range of from 10 to 60 g/cm. It is contemplated that it may be desirable to set the first blade at a lower load so as to function primarily as the cleaner of the bulk of the toned patches and a trapper of lint, paper dust and oil, while the second blade is set at a higher load to complete the cleaning operation. This result can be achieved by making adjustments to the cleaning blades 12, 14 (e.g., by varying the thickness t, width w, or material of the flexible blade elements 12B, 14B) and/or by varying the depth of the blade-supporting notches 21A, 21B, 22A, 22B in the sump housing 16. In this embodiment, it is preferred that both blades 12, 14 be set at the same load. A preferred spacing between the two cleaning blades 12, 14 is between 0.250 and 0.750" to reduce any chance of toner spilling while allowing enough room for particles to flow down into the sump housing 16.

The multi-purpose lid assembly LA comprises a lid member 18 that cooperates with the sump housing 16 to provide a substantially enclosed chamber for particulate material scavenged from the web. Lid member 18 is preferably fabricated from a static dissipative plastic material; it may, however, be made of a light weight metal, such as aluminum. Preferably, the lid member 18 is designed to snap onto the top of the sump housing 16. Alternatively, it may be rigidly connected to the sump housing 16 by suitable fasteners 17 (as shown in FIG. 3).

As shown in FIG. 6, lid member 18 has a substantially planar surface PS in which a substantially rectangular opening 18B is formed. Blade elements 12B and 14B of the cleaning blades 12, 14 project though the opening 18B when the blades 12, 14 are seated in the sump housing 16. A flange 18C, best shown in FIG. 3, extends downwardly from the downstream edge of opening 18B and serves to provide backup support for a foam seal 29 located behind the second cleaning blade 14. Seal 29 operates to seal the downstream end of the cartridge from loss of scavenged particles through opening 18B. Seal 29 does not contact the moving web 116, and it should be separated from the web 116 by at least 0.075" to prevent possible toner recontamination due to slight build up of toner from the collisions of the blade elements 12B, 14B with a splice SP in web 116.

A second flange 18D extending upwardly from the upstream edge of opening 18B at an angle Y serves to support a thin, flexible seal blade 25 that projects upwardly from lid member 18, generally towards the first cleaning blade 12. In addition to sealing the upstream end of the cartridge from a loss of scavenged particles during use, seal blade 25 also acts to deflect particles wiped from the web by blade 12 toward and through the lid opening 18B and ultimately into the underlying sump housing 16. The gap between the free edge of seal blade 25 and the first cleaning blade 12 is relatively narrow, preferably being between 0.150" and 0.750" in width to reduce any chance of scavenged particle spillage or leakage. Seal blade 25 is relatively thin (e.g., less than 0.004") and extends at a relatively shallow angle Y (see FIG. 3) between 15 and 30 degrees relative to the web surface. At such an angle, the seal blade 16 has minimal effect on scavenging particulate material from the web 116. The seal blade dimensions are selected to minimize waviness in the blade edge. Several materials are preferred, including polyesters, nylon, polycarbonate, polyethylene, and the thickness of seal blade 25 is preferably less than 0.0025". The free extension of blade 25 (i.e., that part that extends beyond the edge of tab 18A) is preferably less than 1" to minimize waves but more than 0.100" to maintain a flexibility that prevents particle scavenging. The preferred range of free extension is between 0.300" and 0.600". Preferably, the forward end of lid member 18 is shaped to define an elongated cavity 19 that extends across the entire width of the lid and operates as an auxiliary external sump adapted to collect and contain any particulate material that may get deflected from the web 116 upstream of the intended web-cleaning location (e.g., by seal blade 25).

Lid assembly LA further comprises a pair of foam seals 27, 28 that are attached to lid member 18 at both sides of the sump housing. These seals serve both to minimize any leakage of scavenged particles out of the sides of the sump during use of the cartridge, and to wipe particles from the sides of the web 116. Each seal has an adhesive on the side facing the lid member and a wear-resistant fabric, e.g., Nylon, on the side facing the web 116. These seals minimize any leakage of scavenged particles from the sides of the sump during use of the cleaning apparatus. The foam portion of the seal needs to be of high resiliency, low density, and a low compression set to maintain a good seal and to reduce any drag torque on the transport web 116. A preferred foam material is R200/U polyester having a density of 2 lb. per cubic cm. The Tricot fabric also serves to reduce friction between the web surface and the seal 27, 28, and it provides some cleaning of the web surface not covered by the blades 12, 14.

Baffle 20 is made out of static dissipative plastic or metal such as aluminum or steel. Preferably, it is fabricated as a separate part to be installed into the sump housing 16 or is fabricated as in integral part of the mold. The baffle 20 comprises a plurality of spaced walls 20A that are arranged at a common angle (between about 15 and 45 degrees) relative to the side walls 21, 22 of the sump housing 16. Walls 20A serve to drive scavenged particles toward the upstream side of the sump housing 16 whenever the CRCC is dropped at the front for removal or servicing. The baffle 20 is also designed to extend from side to side of the reservoir R or as much as possible and the walls 20A are higher in front of the first blade 12 since the reservoir R is designed to have most storage capacity or volume in front of the first blade 12.

Referring to FIG. 2, the backup shoe assembly SA comprises of a hard shoe 40 having a conductive and wear-resistant surface to avoid charge buildup. Shoe 40 has a large radius to provide hard backing to both cleaning blades 12, 14. Backup shoe assembly SA further comprises a front bracket portion 42 with features to allow precise positioning of the CRCC with respect to the shoe 40 and a latching function with respect to the support bracket assembly BA, and a rear bracket portion 44 having a slot feature that provides precise positioning of the cleaning cartridge CRCC with respect to the shoe 40. The backup assembly BA is positioned to the web frame so as to allow the shoe to generate some wrap with the transport web. The back-up assembly is rigidly connected to the web-transport frame F by a series of mounting features 46. Thus, the back-up assembly BA remains fixed in the printing machine.

Referring again to FIG. 4, the support bracket assembly BA that supports the CRCC comprises a frame 50 having a rectangular opening 52 adapted to receive and support the CRCC's sump housing 16. The CRCC is installed in the support bracket assembly BA by simply separating the support bracket assembly BA from the back-up shoe assembly SA and dropping the sump housing 16 into opening 52. An edge feature 52A on frame 50 assures that the CRCC is received in the proper orientation, i.e., so that the cleaning blades 12, 14 operate in a wiping mode. Further details of the back-up shoe assembly BA and support bracket assemblies are disclosed in the cross-referenced application noted above.

While the invention has been described in detail with particular reference to a presently preferred embodiment, it will be understood that variations can be effected without departing from the spirit and scope of the invention.

Parts List

100 document printer
103 image-forming member
104 cleaning brush
105 primary corona charger
106 laser scanner
107 magnetic brush applicator
108 image-transfer member
109 image-transfer nip
110 second image-transfer nip
111 cleaning brush
112 sheet-feed station
113, 114 web-transport rollers
116 sheet-transport web
121 transfer roller
124 corona charger
126 detack charger
126 conditioning charger
129 conditioner charger
130 web-cleaning apparatus
141 electrically-conductive drum
142 hard overcoat
143 compliant blanket
150, 152 power supplies
12, 14 cleaning blades
12B, 14B blade elements
13 flexible blade element
15 stiffening plate
1B bend in stiffening plate
16 sump housing
16F flanges on sump housing
17 fasteners
18 lid member
18B blade opening in lid member
18C, 18D flanges on lid member
19 cavity or auxiliary external sump
20 baffle
20A baffle walls
21, 22 side walls of sump housing
21A, 21B; 22A, 22B blade-receiving notches
25 seal blade
27, 28 side seals
29 foam seal
40 hard shoe
42, 44 front and rear bracket portions
46 mounting features
50 bracket assembly frame
52 frame opening for CRCC
52A edge features
D densitometer
F web transport frame
M motor
R reservoir S image-receiver sheets
t blade thickness
T blade extension tabs
w blade width
X angle between PS and blade elements
Y seal blade mounting angle
Z blade interface with web surface
BA bracket assembly
LA lid assembly
SA shoe assembly
PS planar surface on lid member
SP web splice
TR tray
TP toner patches
CRCC customer-replaceable cleaning cartridge

What is claimed is:

1. A cleaning cartridge adapted for use in a web-cleaning apparatus for removing particulate material from a surface of a moving web, said cartridge comprising:

(a) a pair of cleaning blades, each comprising an elongated rigid member having a rectilinear edge with a flexible blade element extending outwardly therealong;

(b) a sump housing for receiving and storing particulate material, said sump housing having opposing side walls shaped to receive and support therebetween said pair of cleaning blades in a spaced, parallel relationship; and (c) a lid assembly, operatively connected to said sump housing to form a substantially enclosed chamber therewith, said lid assembly comprising a lid member having a substantially planar upper surface with an elongated opening through which said flexible blade elements of said cleaning blades project at a first acute angle relative to said planar upper surface when said cleaning blades are supported by said opposing side walls, said opening having a rectilinear lip supporting a flexible seal blade with a rectilinear edge spaced from said cleaning blades and extending parallel thereto, said seal blade being substantially more flexible than said blade elements and extending at a second acute angle relative to said upper planar surface.

2. The cleaning cartridge as defined by claim 1 wherein said second acute angle is less than said first acute angle.

3. The cleaning cartridge as defined by claim 1 wherein a portion of said lid member defines a cavity external to said sump housing for receiving particulate material removed from said web by said flexible seal blade.

4. The cleaning cartridge as defined by claim 1 wherein said lid assembly further comprises a pair of resilient seals supported atop said upper planar surface at locations along opposite sides of said lid member.

5. The cleaning cartridge as defined by claim 4 wherein each of said resilient seals supports a low friction, wear-resistant fabric on the side facing said web.

6. The cleaning cartridge as defined by claim 1 wherein each of the rigid members of said cleaning blades has a pair of tabs that extend axially outward from its opposite ends, and wherein said tabs are releasably received by notches formed in said opposing side walls of said sump housing in order to support said cleaning blades between said side walls.

7. The cleaning cartridge as defined by claim 1 wherein said cleaning cartridge further comprises a multi-wall baffle positioned within said sump housing for uniformly distributing particulate material cleaned from said web throughout the sump housing.

8. Apparatus for cleaning particulate material from a surface of a moving web, said apparatus comprising:

(a) a customer-replaceable cleaning cartridge including a pair of spaced, parallel cleaning blades supported by a sump housing having a removable lid assembly with a narrow opening through which the blades project at an angle;

(b) a backup shoe assembly positioned to contact the web surface opposite the cleaning blades and provide resistance to the cleaning blades; and (c) a bracket assembly for releasably supporting the cleaning cartridge in an operative position in which the cleaning blades contact the web surface to be cleaned and cooperate with the backup shoe assembly to wipe particulate material from the web.

9. The apparatus as defined by claim 8 wherein said lid assembley comprises a lid member that supports a flexible seal blade that contact the web surface upstream of the cleaning blades and deflects particulate material wiped from the web by the cleaning blades into sump housing.

10. The apparatus as defined by claim 9 wherein said lid assembly defines an external cavity that serves as a reservoir for receiving particles inadvertently wiped from the web by the seal blade.

11. The apparatus as defined by claim 8 wherein said lid assembly further comprises a pair of resilient seals supported atop said surface at locations along opposing sides of said lid assembly.

12. The cleaning cartridge as defined by claim 8 wherein each of said cleaning blades comprises an elongated rigid member having a rectilinear edge with a flexible blade element extending outwardly therealong, each of said rigid members having a pair of tabs extending axially outward from its opposite ends, and said tabs being releasably received by notches formed in opposing side walls of said sump housing in order to support said cleaning blades between said side walls.

13. A method for cleaning particulate material from the surface of a moving web, said method comprising:

(a) providing a web-cleaning cartridge including a pair of spaced, parallel cleaning blades adapted to contact said web surface and to wipe particulate material therefrom, a sump housing for supporting said cleaning blades and for receiving and storing particulate material removed from the web surface by said cleaning blades, and a removable lid assembly with a narrow opening through which the blades project at an angle, said lid assembly comprising a lid member having a substantially planar upper surface with an elongated opening through which flexible blade members of said cleaning blades project at a first acute angle relative to said planar upper surface when said cleaning blades are supported by said sump housing, said opening having a rectilinear lip supporting a flexible seal blade with a rectilinear edge spaced from said cleaning blades and extending parallel thereto, said seal blade being positioned to contact said web surface and to deflect particulate material wiped from said web surface by said cleaning blades, toward said sump housing; and (b) supporting the web-cleaning cartridge in an operative position in which the cleaning blades contact the web surface to be cleaned and cooperate with a shoe assembly positioned on the opposite side of the web surface to be cleaned to wipe particulate material from the web.

* * * * *